US005634948A

United States Patent [19]

Sembert

[11] Patent Number: 5,634,948

[45] Date of Patent: Jun. 3, 1997

[54] LOW-FOGGING FINISH TREATMENT FOR UPHOLSTERY LEATHER, AND METHOD

[75] Inventor: George P. Sembert, Greensboro, N.C.

[73] Assignee: Boehme Filatex, Inc., Reidsville, N.C.

[21] Appl. No.: 499,812

[22] Filed: Jul. 10, 1995

[51] Int. Cl.[6] ..... C14C 9/02

[52] U.S. Cl. ..... 8/94.23; 252/8.57; 554/96; 554/98; 554/85

[58] Field of Search ..... 8/94.21, 94.22, 8/94.23; 252/8.57; 554/96, 98, 85

[56] References Cited

U.S. PATENT DOCUMENTS

| | | | |
|---|---|---|---|
| 4,903,362 | 2/1990 | Friese et al. | 8/94.23 |
| 5,348,807 | 9/1994 | Hodder et al. | 428/473 |
| 5,391,784 | 2/1995 | Brehn et al. | 554/98 |

FOREIGN PATENT DOCUMENTS 0581327 2/1994 European Pat. Off. .

OTHER PUBLICATIONS

Fisons Instruments, Stop Undesirable Fogging, pp. 1–6, Mar. 1987, Paramus, N.J.

*Primary Examiner*—Alan D. Diamond
*Attorney, Agent, or Firm*—W. Thad Adams, III, P.A.

[57] ABSTRACT

A method of imparting low fogging characteristics to tanned leather, which includes the step of treating the leather in an aqueous emulsion including an effective quantity of an oil having less than 3 percent of fatty acid components of less than C-16, the oil having been first distilled to remove low molecular weight trace elements. The oil may be by way of example soybean oil, lard oil, safflower oil, or sunflower oil.

6 Claims, No Drawings

LOW-FOGGING FINISH TREATMENT FOR UPHOLSTERY LEATHER, AND METHOD

TECHNICAL FIELD AND BACKGROUND OF THE INVENTION

This invention relates to a low-fogging finish treatment for upholstery leather, particularly for leather used as upholstery in automobiles and aircraft. The basic method of the invention involves the use of a fatliquoring agent for finish-treating upholstery leathers which includes the use of a distilled oil of vegetable or animal origin that has less than 3 percent fatty acid components of less than 16 carbon atoms.

The present invention is directed to a method and product for finish-treating tanned leather to significantly lower the tendency of the leather to give off low molecular-weight trace components which condense and accumulate on clear glass and plastic surfaces such as windows, windshields, dashboard instrument covers and the like. This occurrence is known as "fogging", and is highly undesirable. Aside from the aesthetic objections to the presence of a milky white or translucent oily substance on the interior surfaces which must be removed, fogging impedes the vision of the driver, particularly at night when the driver is faced with lights from oncoming traffic reflecting off of the fogged windshield.

Also, dust and dirt brought into the vehicle interior by the ventilation system can bond to these fogging components, causing a further decrease in visibility.

Because of the various aesthetic and safety concerns relating to fogging, including those mentioned above, automobile companies have established standards, against which upholstery leather is measured to determine its tendency to give off elements which cause fogging.

All leather must be tanned before it is suitable for use as upholstery leather. Tanning removes fats and oils naturally in the hides and conditions the hides for the end use to which they will be put. Depending on the end use, tanning may enhance strength, suppleness, resilience or resistance to wear. Often, all of these characteristics must be present to some degree, and part of the tanning process includes determining how to treat the leather in order to obtain an appropriate balance between these and other similar characteristics.

Typically, finish steps are required to add back certain elements of the leather to achieve desirable results. Finish steps typically add back oils removed from the leather during tanning, which provide softness, suppleness and other desirable characteristics to the tanned leather. It is these elements added back during finish treating which cause fogging. This finish process is called "fatliquoring", and is used to impart the desired properties to the tanned leather. Fatliquors lubricate the leather fibers so that after the leather is dried its fibers are capable of sliding over each other, thus rendering the leather pliable, and increasing the tensile and tearing strength of the leather. Fatliquoring also enhances the physical appearance of the leather by minimizing the tendency of the leather to permanently crease as the leather is bent or folded. Ideally, bending or creasing the leather produces only minimal fine wrinkles.

Some prior art processes of fatliquoring tanned leather require that the leather be baked to drive off volatile substances contained in the oils, solvents and emulsifiers contained in the fatliquor. Other prior art processes involve the use of a selected amphiphilic copolymer as a substantially solventless fatliquor. See, U.S. Pat. No. 5,348,807 to Hodders.

SUMMARY OF THE INVENTION

Therefore, it is an object of the invention to provide a fatliquoring composition which imparts low-fogging characteristics to tanned leather treated with the composition.

It is another object of the invention to provide a fatliquoring composition which enhances the aesthetic and wear characteristics of tanned leather treated with the composition.

It is another object of the invention to provide a method of treating tanned leather to impart low-fogging characteristics to the leather.

It is another object of the invention to provide a method of producing a low-fogging fatliquor.

These and other objects of the present invention are achieved in the preferred embodiments disclosed below by providing a method of imparting low fogging characteristics to tanned leather, comprising the step of treating the leather in an aqueous emulsion including an effective quantity of an oil having less than 3 percent of fatty acid components of less than C-16, the oil having been first distilled to remove low molecular weight trace elements.

According to one preferred embodiment of the invention, the oil comprises an oil selected from the group consisting of soybean oil, lard oil, safflower oil and sunflower oil.

According to another preferred embodiment of the invention, the oil is oxidized.

According to yet another preferred embodiment of the invention, the oil is bisulfated or bisulfited.

According to yet another preferred embodiment of the invention, a method of preparing a fatliquor for imparting low fogging characteristics to tanned leather, comprises the steps of selecting an oil having less than 3 percent of fatty acid components of less than C-16, distilling the oil to remove low molecular weight trace elements, bisulfating or bisulfiting the oil, emulsifying the oil in an aqueous emulsion, and processing tanned leather in the emulsion.

According to yet another preferred embodiment of the invention, the step of processing the leather in a aqueous emulsion comprises the steps of processing the leather in a first retannage aqueous emulsion and subsequently in a second main fatliquor aqueous emulsion.

According to yet another preferred embodiment of the invention, the oil is present in the retannage within a range of 3 to 6 percent by weight.

According to yet another preferred embodiment of the invention, the oil is present in the main fatliquor emulsion within a range of 6–20 percent by weight. The preferable range within this broader range is 8–15%.

According to one preferred embodiment of a fatliquoring composition according to the invention, the fatliquoring composition comprises an oxidized, bisulfated or bisulfited, distilled oil having less than 3 percent of fatty acid components of less than C-16, the distillation having removed low molecular weight trace elements from the oil.

According to yet another preferred embodiment of the invention, the oil comprises an oil selected from the group consisting of soybean oil, lard oil, safflower oil and sunflower oil.

DESCRIPTION OF THE PREFERRED EMBODIMENT AND BEST MODE

The invention is directed towards the use of suspensions, dispersions and emulsions—preferably emulsions—in a fatliquoring process which imparts low-fogging characteristics to tanned leather, while preserving or enhancing other necessary and desirable characteristics such as strength, resilience, pliability, drape, hand and softness.

It has been determined that oils of the particular type disclosed and claimed in this application remain in the treated leather to impart characteristics such as those mentioned above while providing low-fogging characteristics now required by automobile manufacturers.

The invention is described and disclosed below by way of example only:

Selection of Suitable Oil

Oils suitable for use in the fatliquoring composition disclosed in this application should have less than 3 percent of fatty acid components, wherein the length of the carbon chain of those fatty acid components is less than 16. The length of the carbon chain is commonly referred to by the designation "C", followed by the number of carbon atoms in the carbon chain. For example, "C-16" designates Palmitic acid, which has 16 carbon atoms in its carbon chain. Oils which meet this condition include soybean oil, lard oil, safflower oil and sunflower oil. These oils are natural fatty ester oils of vegetable or animal origin.

Processing the Oil

The preferred oil for use in fatliquoring tanned leather to impart low-fogging characteristics is "blown Soya J-L" oil. By "blown" is meant that the oil is oxidized to permit later bisulfating or bisulfiting of the oil. The J-L designation refers to the viscosity.

1. The blown soya oil is distilled by adding 0.2% HQMME (hydroquinone monomethyl ether) as an antioxidant, and then heating the oil under a 500 mm Hg vacuum (equivalent to 260 mm Hg pressure) and with a nitrogen blanket (to prevent discoloring) to 165° C., and holding those conditions for at least 30 minutes while stirring in a reaction vessel. This process drives off low molecular weight volatile compositions which cause fogging if applied to the leather. Vacuum, time and temperature values can vary depending on empirically-determined processing differences.

2. The oil is then cooled to 50° C.

3. The distilled oil is then used to produce a fatliquoring composition.

Analysis of the distillate according to gas chromatography/mass spectroscopy indicates the following identifiable components were distilled out of the soya oil during the above process:

| | |
|---|---|
| cyclopropane, pentyl- | 15.3% |
| oxirane, 2-ethyl-3-propyl-,cis | 5.3 |
| nonanal | 2.4 |
| phenol, 4-methoxy- | 5.2 |
| 2-decenal | 2.7 |
| 2,4-dodecadienal | 9.1 |
| 1-heneicosyl formate | 1.9 |

The remaining 58.1% could not be identified, or were for compounds of less than 1% each. As can be seen, removal of these components will have a substantial downstream impact on the quantity of low molecular weight volatiles which subsequently cause fogging.

Processing Fatliguoring Composition

A fatliquoring composition by way of example according to a preferred embodiment of the invention contains the following components:

| | |
|---|---|
| Distilled Soya, per above process | 51.37% |
| Sodium Acetate (Anhydrous) | 1.18 |
| Sodium Bidulfite | 2.67 |
| Stearic Acid/Ammonium Hydroxide 28% | 4.40 |
| Water | 22.41 |
| Hostapur SAS-60 | 17.87 |
| Dowicil 75 | 0.10 |
| | 100.00% |

The Stearic Acid/Ammonium Hydroxide acts as a higher saturated fatty acid salt with 51% actives, and is a "hand" modifier. Hostapur SAS-60 is one of many suitable alkyl sulfonate salts which acts as a co-emulsifier. Dowicil is a suitable biocide/preservative.

1. All of the components except the Dowicil biocide/preservative are mixed and heated to 90°–95° C. under a nitrogen blanket (to prevent discoloring) and held at that temperature for 2 hours, with agitation.

2. The mixture is then cooled to below 50° C. and the Dowicil is added.

3. The result is a yellow opaque liquid with the following characteristics:

| | |
|---|---|
| pH (10%) | 7.6% |
| Bake Down Solids | 76.45% |
| Spec. Grav. | 0.9724 |
| Viscosity (RVT 3/20) | 4400 cps |

The viscosity value represents Brookfield viscosity in cps, using a model RVT, spindle 3 at 20 rpm.

The bisulfation allows the mixture to be emulsified, dispersed or suspended in water, and increases the affinity between the leather to be treated and the oil. Bisulfition may be substituted for bisulfation.

Application Method

The fatliquor composition is applied according to the following procedure:

1. The leathers used for the procedure were 3 natural color, chrome-tanned cowhides measuring approximately 120 sq.ft. in area; and a one-half of a single natural color, chrome-tanned hide measuring approximately 20 sq.ft. in area. The half hide and the three full hides were processed at different times, both according to the following procedure.

2. The hides were washed at room temperature for 15 minutes in an open drum according to conventional practice.

Neutralizing

3. The hides were neutralized in a 100% float (meaning the addition of water equal to the weight of the hides) with 3% lubricant to aid in the mechanical movement of the hides, 2% organic buffering salt, 1.5% alkaline neutralizing agent. The hides were drummed in this solution for 90 minutes at 100° F.

4. The neutralizing solution was drained and another 100% float introduced into the drum;

Retannage

5. To the float was added 4% acrylic syntan, and drummed for 30 minutes.

6. 8% inert filler was added and drummed for 30 minutes.

7. 3% of the fatliquor composition according to the invention was added, and the mixture was drummed for 30 minutes.

8. 1.5% dyestuff and 1.5 % formic acid were added and the mixture was drummed for 90 minutes.

9. The mixture was drained, and the hides were washed in three sequential water baths at 120° F.

Primary Fatliquoring 10. 9% fatliquor composition according to the invention example set out above was added to a 100% float and the hides were drummed for 60 minutes.

11. 1% formic acid was added and the mixture was drummed for 15 minutes.

12. The mixture was drained, and the hides were washed in two sequential water baths 15 minutes each at 70° F.

13. The hides were dried and conditioned for 24 hours in a desiccator at 72° F., and were then mechanically softened.

The results were hides which had a soft hand, and which gave the following fogging results:

Reflectance ranged between 91.9% and 79.3%, averaging 87.350% using the Hart III test device; and between 73.5% and 81.3%, averaging 78.150% on a Haake I test device.

Gravimetric values were between 0.960 mg and 1.140 mg, averaging 1.050 mg using the Haake I test device, and between 0.400 mg and 0.580 mg, averaging 0.490 mg, using the Hart II test device.

A method of treating leather to impart low-fogging characteristics is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A method of preparing a fatliquor for imparting low fogging characteristics to tanned leather, comprising the steps of:

(a) selecting an oil having less than 3 percent of fatty acid components of less than C-16 from the group consisting of soybean oil, lard oil, safflower oil and sunflower oil;

(b) distilling said oil to remove volatile elements which cause fogging;

(c) bisulfating or bisulfiting the distilled oil to facilitate emulsification; and (d) emulsifying the bisulfated or bisulfited oil in an aqueous emulsion.

2. A method of imparting low fogging characteristics to tanned leather, comprising the steps of (a) selecting an oil having less than 3 percent of fatty acid components of less than C-16 from the group consisting of soybean oil, lard oil, safflower oil and sunflower oil;

(b) distilling said oil to remove volatile elements which cause fogging;

(c) bisulfating or bisulfiting the distilled oil to facilitate emulsification;

(d) emulsifying the bisulfated or bisulfited oil in an aqueous emulsion; and (e) treating said tanned leather in said aqueous emulsion.

3. A method according to claim 2, wherein the bisulfated or bisulfited oil of step (c) is emulsified in a retannage aqueous emulsion and a main fatliquor aqueous emulsion, and wherein step (e) comprises:

(e1) treating said tanned leather in said retannage aqueous emulsion; and (e2) treating said tanned leather in said main fatliquor aqueous emulsion.

4. A method according to claim 3, wherein the bisulfated or bisulfited oil of step (c) is present in said retannage emulsion within a range of 3 to 6 percent by weight.

5. A method according to claim 3 wherein the bisulfated or bisulfited oil of step (c) is present in said main fatliquor emulsion within a range of 6–20 percent by weight.

6. A fatliquoring composition for treating tanned leather to impart low-fogging characteristics to the leather, consisting essentially of:

(a) an oxidized, bisulfated or bisulfited soybean oil, lard oil, safflower oil or sunflower oil having less than 3 percent of fatty acid components of less than C-16;

(b) wherein said oil has been distilled to remove volatile elements which cause fogging.

* * * * *